US006543105B1

(12) United States Patent
Kemp et al.

(10) Patent No.: US 6,543,105 B1
(45) Date of Patent: Apr. 8, 2003

(54) DEVICE FOR INTERMINGLING RELAXING AND/OR THERMOSETTING OF FILAMENT YARN IN A SPINNING PROCESS

(75) Inventors: Ulrich Kemp, Domat/Ems (CH); Marcel Ruppenthal, Domat/Ems (CH)

(73) Assignee: Inventa-Fisher AG, Zurich (CH)

( * ) Notice: Subject to any disclaimer, the term of this patent is extended or adjusted under 35 U.S.C. 154(b) by 0 days.

(21) Appl. No.: 09/578,722

(22) Filed: May 26, 2000

(30) Foreign Application Priority Data

May 28, 1999 (DE) ..... 199 24 436
Mar. 29, 2000 (DE) ..... 100 15 454

(51) Int. Cl.[7] ..... D02G 1/16
(52) U.S. Cl. ..... 28/274; 28/271
(58) Field of Search ..... 28/271, 272, 273, 28/274, 275, 281, 258, 220, 219; 425/72.2, 387.1, 404, 445

(56) References Cited

U.S. PATENT DOCUMENTS

| | | | | | |
|---|---|---|---|---|---|
| 2,586,800 | A | * | 2/1952 | Elvin et al. | 28/273 |
| 3,452,132 | A | * | 6/1969 | Pitzl | 264/290 |
| 3,455,096 | A | * | 7/1969 | Whitley | 28/275 |
| 3,638,291 | A | * | 2/1972 | Yngve | 28/273 |
| 3,669,328 | A | * | 6/1972 | Castelli | 28/274 |
| 3,694,131 | A | * | 9/1972 | Stuart | 28/273 |
| 4,004,329 | A | * | 1/1977 | London, Jr. et al. | 28/274 |
| 4,069,565 | A | * | 1/1978 | Negishi et al. | 28/274 |
| 4,417,375 | A | * | 11/1983 | Sano et al. | 28/275 |
| 4,949,441 | A | * | 8/1990 | Ethridge | 28/275 |
| 5,019,316 | A | * | 5/1991 | Ueda et al. | 264/178 F |
| 5,351,374 | A | * | 10/1994 | Nabulon et al. | 28/271 |
| 5,390,400 | A | * | 2/1995 | Jacob et al. | 28/274 |
| 5,487,860 | A | | 1/1996 | Kent et al. | 264/103 |
| 5,511,295 | A | * | 4/1996 | Shah | 28/273 |
| 5,558,826 | A | | 9/1996 | Jaegge et al. | 264/103 |
| 5,634,249 | A | | 6/1997 | Ballarati | 28/246 |
| 5,750,215 | A | | 5/1998 | Jaegge et al. | 428/34.2 |
| 6,088,892 | A | * | 7/2000 | Bertsch et al. | 28/273 |

FOREIGN PATENT DOCUMENTS

| | | |
|---|---|---|
| CH | 623 611 A5 | 6/1980 |
| DE | 22 04 397 | 8/1973 |
| DE | 25 25 699 | 12/1976 |
| DE | 26 43 787 | 3/1978 |
| DE | 33 46 677 | 7/1985 |
| DE | 195 46 784 C2 | 6/1997 |
| EP | 0 703 306 | 3/1996 |
| WO | 98/23797 | 6/1998 |
| WO | 99/45182 | 9/1999 |

* cited by examiner

*Primary Examiner*—Amy B. Vanatta
(74) *Attorney, Agent, or Firm*—Morgan, Lewis & Bockius LLP

(57) ABSTRACT

The device (80) described can be used in universal fashion for the intermingling, relaxing, and/or thermosetting of filament yarn (50) in a melt spinning process. It comprises a treatment chamber (80, 81), which is capable of being filled with a gas under essentially static overpressure and increased temperature, and features an intake aperture (83) and an outlet aperture (84), designed for preference as nozzles, for the passage of the yarn (50), through which the gas can flow, under pressure relief, respectively in or against the direction of the run of the yarn (50).

17 Claims, 7 Drawing Sheets

DEVICE FOR INTERMINGLING RELAXING AND/OR THERMOSETTING OF FILAMENT YARN IN A SPINNING PROCESS

TECHNICAL SECTOR

The present invention relates to a device for intermingling, relaxing, and/or thermosetting of filament yarn in a melt spinning process, as well as associated processes.

During the melt spinning of filament yarns, a melt-spinnable polymer is melted and, in this state, is extruded through fine nozzle orifices of a spinneret plate. This results in a number of melt strands, which are solidified by cooling in an air stream, and are drawn out over a number of rollers with increasing surface speed to form fine filaments. These are then merged to form a unitary yarn, and are finally wound up as bobbins.

The drawing of the filaments is effected on the one hand, provided they are not yet solidified and the polymer has not yet fully crystallised out and is still somewhat capable of flowing, in the area of the cooling way upstream of the first godet roller. This is also referred to as spin drawing. On the other hand, the filaments, after solidifying, are mostly mechanically drawn, as a result of which an orientation effect of the macromolecules of the polymer is achieved, and the definitive expansion and strength values of the yarn are set.

The ratio between spin drawing and mechanical drawing is dependent on the spinning speed. The lower the spinning speed, the higher the degree of mechanical drawing required to obtain what is referred to as fully-drawn yarn. The draw ratio can in this situation be up to 1:4. At medium to low operating speeds (depending on the polymer used, for example, up to about 50 m/s), it may therefore be necessary for the filaments in the area of the drawing zone to be heated up to a temperature above the glass transition point of the second order, in order to facilitate drawing. At high spinning speeds (depending on the polymer used, for example, above about 85 m/s), the draw ratio is substantially smaller, and typically amounts to only about 1:1.3, as a result of which such additional heat treatment can be done away with.

After the extrusion, i.e. the spin drawing and/or drawing, there remain internal tensions in the filaments, which impair the form stability of the yarn, and may lead to the yarn being shortened as tension builds up on the bobbin, with the result that, as a minimum, it becomes impossible to continue winding without some intervention. The forces which arise in this situation may even lead to the destruction of the bobbin tubes. In order to avoid this disadvantageous effect, the yarn is in most cases, after drawing has been carried out, subjected to a repeat heat treatment, by means of which, among other things, it is already shortened before winding, an effect referred to as relaxation shrinkage.

Each filament yarn is also inclined to shorten still further, if subjected after manufacture to higher temperatures of, for example, 100° C. or more. This tendency towards longitudinal contraction is referred to, depending on the temperature treatment, as shrinkage at the boil (water 95° C.–100° C.) or hot-air shrinkage (hot air 160° C.–200° C.), in which situation downstream industry will only tolerate yarn of which the shrinkage values are within certain limits, e.g. shrinkage at the boil between 6% and 11%. This procedure, referred to as thermal shrinkage can also be reduced by heat treatment of the yarn after drawing, designated hereinafter as thermosetting. Compared with relaxation, however, in this case the attainment of a higher temperature and/or longer period of treatment is required. It has also been shown that, by increasing the spinning speed, the orientation of the macromolecules can be increased in such a way that the yarn will already feature conventional commercial thermal shrinkage values without additional thermosetting. In such a case, relaxation is sufficient to achieve adequate longitudinal stability of the yarn on the bobbin.

In order to improve the cohesion of the individual filaments in the yarn, and therefore improving what is referred to as the thread cohesion, the filaments are frequently also provided with a thread cohesion medium and/or entangled, with the intermingling being carried out as the final stage before winding, but in any event after drawing has been carried out. A distinction needs to be drawn between this and what is referred to as pre-intermingling before drawing. This treatment serves only to provide even distribution of the spin finish preparation on the thread, and a certain degree of cohesion of the filaments, in order in this way to suppress the separation and breakage of individual filaments during the subsequent drawing process. The larger part of the pre-intermingling process applied is nullified again by the drawing process.

PRIOR ART

Known in the prior art are processes and devices for intermingling, relaxation, and thermosetting, although these are not capable of use, or at least are not effective, in respect of all three types of processing, simultaneously or alternatively, and, in addition, are characterised in terms of apparatus by being either elaborate or expensive, and/or by high consumption of energy or treatment gas.

In the case of yarns produced at low to medium spinning speeds, the prior art allows for control of the thermal shrinkage values to be achieved by the fact that the threads are subjected, after drawing, to adjustable heat treatment by means of heated drawing godets.

As already mentioned, increasing the spinning speed allows for the orientation of the macromolecules in the thread to be increased in such a way that the yarn also features a commercially conventional thermal shrinkage after drawing, even without heat treatment. In this case, only relaxation of the yarn is required in order to avoid shrinkage of the yarn on the bobbin and damage to it. CH 623 611 describes such a process, whereby the yarn is guided through one or more steam jets after drawing by means of unheated godets, the steam emerging from apertures in a treatment chamber open to the side, arranged approximately at right angles to the yarn. The steam nozzles are fed with an overpressure of some 1.7 bar (g), but the steam relaxes to atmospheric pressure almost entirely on emergence from the nozzles, with the result that the yarn may be said to be processed at atmospheric pressure. Accordingly, the maximum steam processing temperatures for the yarn which can be achieved are only about 105° C. In addition to relaxation, during this process intermingling of the individual filaments of the yarn also takes place.

U.S. Pat. No. 5,750,215 and U.S. Pat. No. 5,558,826 describe in similar fashion a relaxation process and intermingling with steam, with mentioned also being made of thermosetting adjustment. In this case, too, according to the description, the yarn is treated under atmospheric pressure. Before winding, however, there is still a certain distance of 2–3 m for the yarn to run after the steam treatment, during which the yarn may undergo additional relaxation (due to "lagging"). It may therefore be doubted whether the steam treatment described is sufficiently effective on its own. In addition to this, a comparable first steam processing of the yarn to determine the drawing point is carried out as early as in the drawing zone between two pairs of godets, which may likewise lead to the impairment of the effect of the second steam treatment. The prognostications for the determination of the drawing point are, incidentally, in contradiction to DE 2204397, in which reference is made to the fact that, as from 3000 m/min, it is no longer possible to set a defined drawing point, and this accordingly need not, or cannot, be monitored any longer.

A further device is described in WO 98/23797, in which several threads are conducted through a steam chamber at atmospheric pressure before being wound up. In the chamber the steam does not impinge on the threads directly, and is released to the outside through lateral apertures. Only relaxation is achieved, and no provision is made for thermosetting or intermingling.

U.S. Pat No. 5,634,249, and EP 0 703 306 which corresponds to it, describes a intermingling effect in a warping process by means of steam, although this relates to the treatment of a yarn already manufactured in a first operational stage, and only partially orientated. The operating speeds, at 584 and 800 m/min respectively, are correspondingly low. In view of the fact that, in the proposed procedure, intermingling is carried out simultaneously and at the same location as the drawing, it is not understandable as to how effective intermingling can take place at all with the high drawn filament tensions which prevail in this situation.

DE 19546784 describes a type of steam chamber for relaxing heat treatment of filament yarn, which makes use of a very special design of nozzle geometry, and by means of which dynamically favourable conditions are intended to be obtained for a complete condensation of the steam and, as a result of this, good thermal transfer to the yarn. The yarn in this situation moves in part through the same nozzle apertures through which the steam flows. Provision is made for a separate intermingling chamber in the intake area of the device, in which a steam jet is imposed onto the yarn from the side.

Use is also made of a technique of conducting the yarn through a chamber subjected to hot steam, in order to heat the yarn for the purpose of facilitating the drawing, in particular at low to medium operating speeds. Corresponding devices are known, for example, from U.S. Pat. No. 5,487,860, DE 2643787, DE 2204397, or DE 33 46 677.

PRESENTATION OF THE INVENTION

The object on which the present invention is based is to provide a device capable of universal application for melt spinning of the type referred to in the preamble, and corresponding processes, by means of which the yarn, as required, is relaxed, entangled, and by means of which a thermoshrinkage adjustment can also be effectively carried out. In addition, the device should also be of simple design and economical in operation. This object is resolved according to the invention by a device with the features of Patent claim 1, as well as by the processes described in claims 13 and 14. Advantageous embodiments and further developments are characterised in the sub-claims.

The device according to the invention comprises a treatment chamber, which is capable of being filled with a gas under an essentially static over-pressure and elevated temperature, and an intake and outlet aperture for the passage of the yarn, which is gas permeable under pressure release, and through which, accordingly, the gas can flow out under pressure release, and in respective contrary to the direction of run of the yarn.

The device according to the invention accordingly no longer, quite particularly, includes any nozzle through which a jet of the processing gas might be directed onto the yarn for the purpose of intermingling it essentially transverse to its direction of run. Rather, the device according to the invention results in a intermingling of the yarn or its filaments on their passing through the intake and/or outlet aperture of the treatment chamber, due to the gas emerging through these apertures with pressure release in or contrary to the direction of run of the yarn.

The intermingling effect which occurs in this situation is surprising, since previous opinion was that the highest intermingling effect is achieved with an impact angle of the gas onto the yarn of 90°, and it was known that, as the angle decreased, the intermingling is largely reduced in proportion. At values of close on 0°, accordingly, practically no more intermingling was to be expected. However, with the device according to the invention, intermingling nevertheless still occurs, and specifically due to the fact that the yarn is passed through (at least) one intermingling nozzle itself (in the form of the intake and/or outlet aperture of the treatment chamber).

With conventional intermingling nozzles, the intermingling rate attained is directly dependent on the gas pressure applied, and therefore on the thrust with which the gas jet imposes on the yarn. The intermingling achieved by the device according to the invention is, by contrast, relatively independent of the gas pressure applied, and exceeds in its level even that of conventional intermingling processes.

The intermingling of the yarn which is achieved is also very gentle. The result is that the yarn features less instances of damage on its surface, and also lower yarn/ceramic friction values than conventionally manufactured yarn. This means that this yarn can be used to advantage in further processing stages.

It was found, surprisingly, that yarn manufactured with the device according to the invention featured entirely closed cohesion of the thread in the water bath, which exhibited no apertures, or practically none, over the entire length of the thread. By contrast, yarns manufactured in the conventional manner feature constrictions in the water bath at intervals of 6 to 8 cm. In between, the thread opens out in balloon fashion into the individual filaments of the thread. Good thread cohesion, such as can be achieved with the device according to the invention, is of great advantage to further processing.

As was further found, surprisingly, the intermingling and cohesion of the thread, created with the device according to the invention, is extraordinarily stable under tension. Accordingly, the decrease in the number of knots per length unit, with increasing tensile stress, at least up to a specific thread tensile strength of 0.5 cN/dtex is at least one order of magnitude (one power of ten) less than with otherwise comparable filament yarns according to the prior art. The specific thread tensile strength mentioned, of 0.5 cN/dtex, corresponds approximately to the loading such as occurs, for example, at weft insertion in a loom, and therefore to a loading such as a thread experiences at the most in usual practice. The object of the present invention is, to this extent, also an entangled filament yarn, in which, as a characteristic feature according to Patent claim 16, the number of knots per unit length decreases up to a specific thread tensile strength of 0.5 cN/dtex by not more than 50%, but in particular by not more than 30%.

This extraordinarily high intermingling stability of the filament yarn according to the invention has a particularly advantageous effect on the degree of efficiency in the weaving mill preparation stage. Fewer shutdowns occur in that case with warping or beaming, and less waste material is generated. This also results in a mill run which is overall freer of operational problems.

In as much as the treatment chamber with the device according to the invention is capable of being filled with a gas at an essentially static overpressure and increased temperature, the gas is to advantage subjected to this pressure and this temperature throughout its entire passage through the treatment chamber, which on the one hand results in a better relaxation. On the other hand, the operational window is also substantially expanded, since an adequate relaxation is already possible at low pressures in the treatment chamber. In respect of thermosetting adjustment, a favourable dependency between the pressure applied and the duration of processing has been demonstrated, with the result that a desired shrinkage is even capable of being specifically adjusted.

For preference, the intake and/or outlet apertures of the treatment chamber are designed as nozzles closely encompassing the yarn, while the treatment chamber features a substantially larger cross-section in relation to them. This facilitates the creation of a largely static overpressure in the treatment chamber, and also reduces the emergence of treatment gas, which has a favourable effect on its consumption. In comparison with conventional intermingling nozzles, for example, this can be reduced to only about ⅓ to ¼. The intermingling effect is not impaired as a result, but is, on the contrary, enhanced.

The cross-section of the intake and/or outlet aperture is, in addition, for preference rectangular, as a result of which the filaments of the yarn, when running through the treatment chamber, are drawn apart to form a flat strip. In this form, they offer a larger surface area to the gas in the treatment chamber, and are more effectively heated by it.

Due to the expansion of the treatment chamber in the direction of run of the yarn (mostly vertical), it is a simple matter to influence the temporal length of treatment. In order to achieve an adequately long period even at higher operational speeds, it is preferable if the expansion of the treatment chamber is substantially greater between its intake and outlet aperture than its width (mostly horizontal) between them.

According to a further preferred embodiment, the treatment chamber features a feed aperture for the treatment gas, the cross-section of which is substantially greater than the cross-section of its intake and/or outlet apertures. This ensures that the gas will not be relaxed as soon as it flows into the treatment chamber, as is the case with conventional intermingling chambers, and accordingly impinges on the yarn as a jet, at a high speed. Rather, a uniform flooding of the treatment chamber, and the formation of a largely static pressure in it, is achieved. The pressure of the treatment gas does not essentially start to relax until it flows out through the intake and/or the outlet aperture.

Following the aforegoing, it can be understood that the treatment chamber, apart from its intake and outlet apertures and the feed aperture for the treatment gas, should as far as possible be completed closed.

It can further be understood that, as a material for the manufacture of the treatment chamber, metal or ceramics can be considered, the latter due to its favourable abrasion-resistant properties. Naturally, a metal provided with an abrasion-resistant coating would also be suitable.

The device according to the invention is used to advantage in a melt spinning system with a spin drawing and/or preliminary drawing line, as well as a winding-up device for the yarn between these two positions. At high spinning speeds in particular, in the range from 75 m/s, it is preferable in this situation if no means are provided in the drawing line for the heating of the yarn, since the effectiveness of the device according to the invention in particular with regard to the relaxing effect and thermosetting is higher without such pre-heating of the yarn. The device according to the invention may also be arranged, in the system referred to, immediately in front of the winding-up station; i.e. no further treatment of the yarn is required, nor does any extra time need to be accorded for possible further shortening, making use of an additional run way.

The device according to the invention is operated for preference with steam, and for preference with water vapour, as the treatment gas, and should be designed with an absolute pressure of up to about 10 bar for this.

The device according to the invention can be used for the entire titre range, i.e. from microfilament yarns through light titres and up to texture yarns, and BCF yarns (carpet yarns) in particular, as well as technical yarns.

BRIEF EXPLANATION OF THE FIGURES

The invention is explained hereinafter in greater detail, on the basis of embodiments in connection with the drawings. These show.

METHODS OF IMPLEMENTATION OF THE INVENTION

Figure 1:
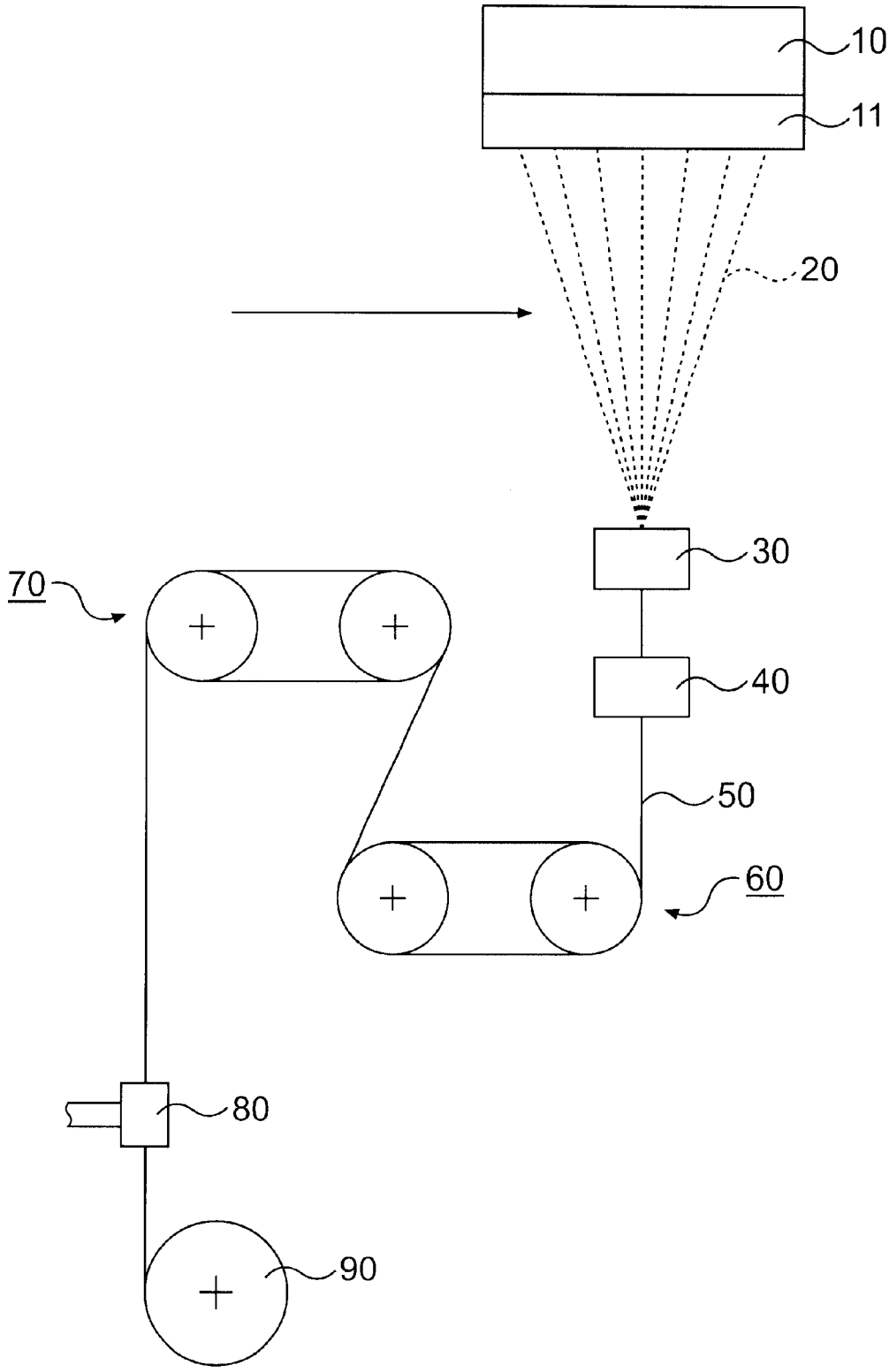
FIG. 1 Schematic diagram of a system for melt spinning with a device according to the invention.

With the melt spinning system of FIG. 1, a polymer capable of melt spinning with a conventional melt-on extruder (not shown here) is first melted with a suitable relative viscosity, and conducted to the spinning package 10 with the spinneret plate 11. The melted polymer is extruded through the spinneret, according to the number of holes in the spinning spinneret plate 11, into the same number of melt streams 20, by means of a conditioned air flow (arrow), in which it is cooled, bundled by means of a spin finish preparation applicator 30, and then conducted through a preliminary intermingling device 40. The yarn 50 is then drawn off by a powered first pair of non-heated godets 60, which are twined around several times, at a defined speed. A second pair of godets 70, likewise twined around several times and likewise not heated, drawns the yarn, inasmuch as they run faster by a specific amount. The godets are for preference provided with smooth ceramic surfaces of a defined low roughness.

After leaving the second pair of godets 70, the yarn runs through a stream treatment chamber 80, and is then wound up by a conventional commercial winder 90 at a speed which is lower than the circumferential speed of the last pair of godets 70 by the relaxation shrinkage which occurs in the chamber 80.

Figure 2:
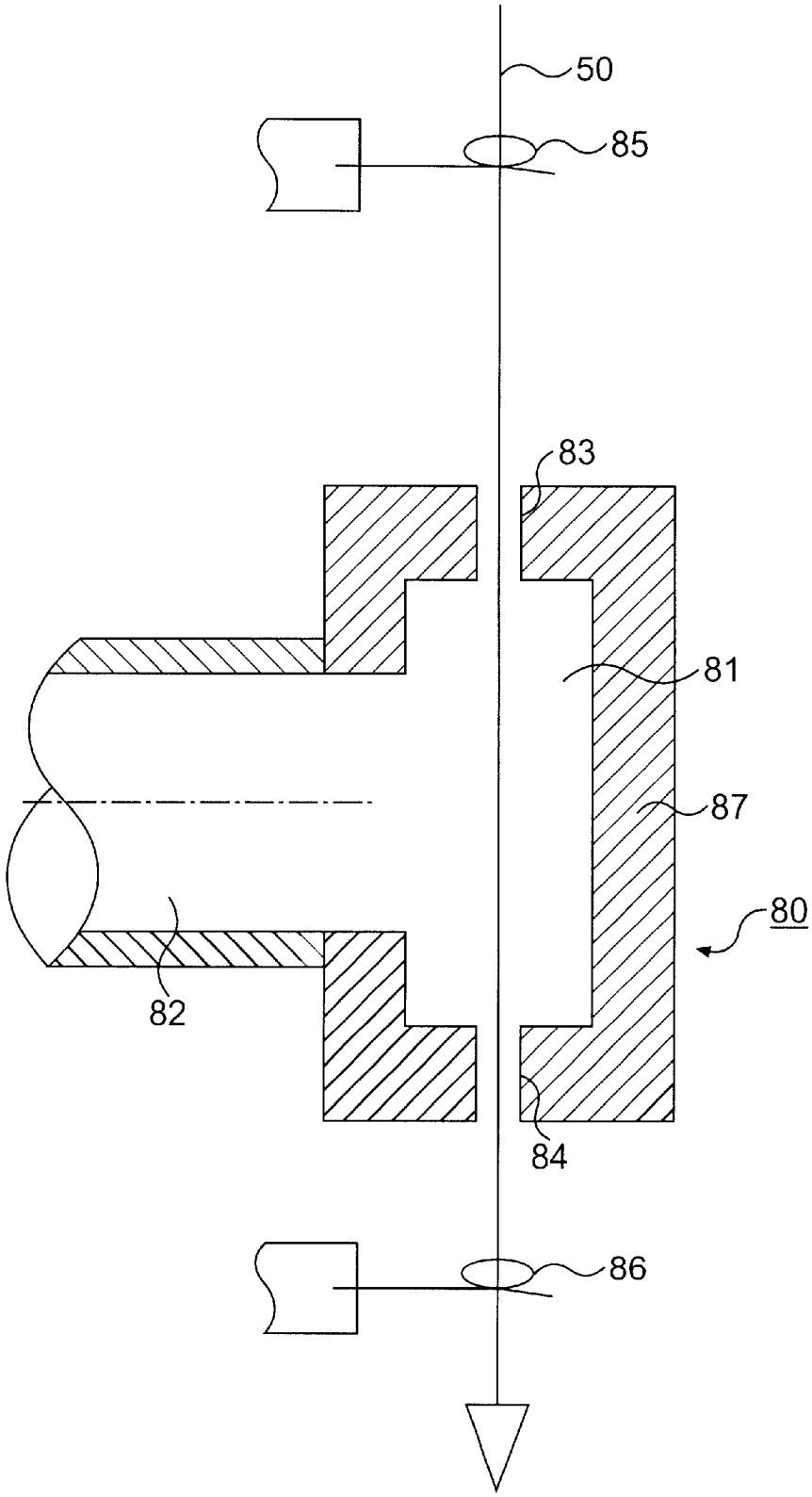
FIG. 2 The treatment chamber of a device according to the invention, in section.

FIG. 2 shows the structure of the treatment chamber. This shows a longitudinally extended treatment chamber 81, practically closed to the outside with the exception of an intake and outlet aperture for the yarn 50, which is provided with the treatment gas at a defined overpressure via a connection nozzle or feed aperture 82 respectively. The cross-section at which the connection nozzle 82 opens into the treatment chamber is perceptibly large, with the result that no pressure drop worth mentioning occurs in this area, and the treatment chamber 81 features essentially the same, semi-static pressure as also pertains in the infeed or connection nozzle 82. By distinction with this, both the intake aperture 83 and the outlet aperture 84 are designed as nozzles closely enclosing the yarn 50, their cross-section being only slightly larger than that of the yarn. Thread guide elements 85 and 86 guide the yarn precisely in the axis of the apertures 83 and 84, which are flush with one another, through the chamber 81. A front cover 87 of the chamber 81 can be removed to insert the running yarn 50.

Figure 3B:
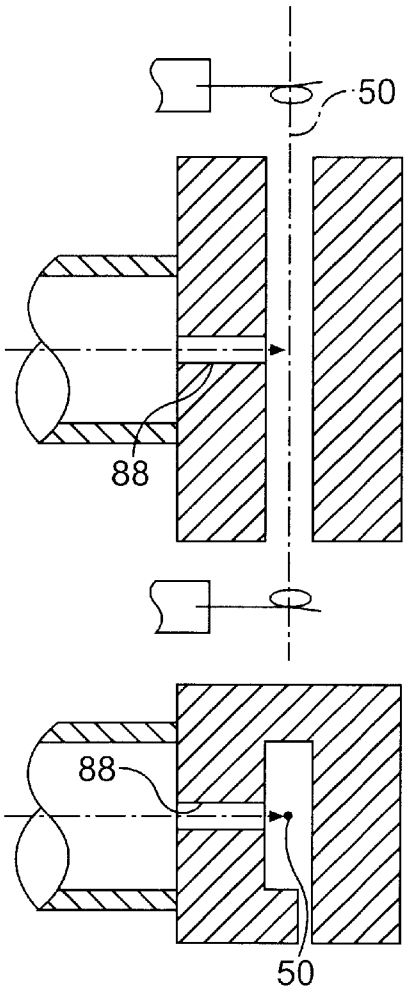
FIG. 3(b) PRIOR ART
FIGS. 3A and 3B Conventional treatment chambers according to the prior art, in each case in a vertical and horizontal section.
Figure 3A:
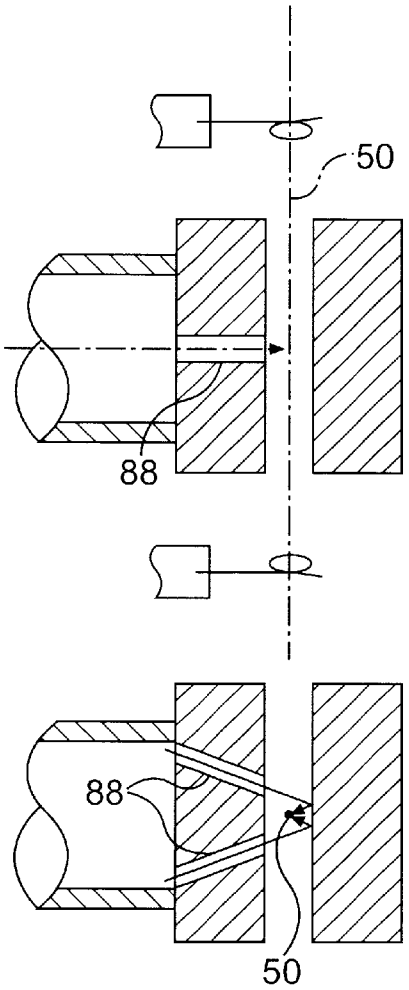
FIG. 3(a) PRIOR ART

FIG. 3 shows under a) and b), by comparison, the principal arrangement of two conventional intermingling nozzles according to the prior art, with a vertical section shown in the upper part of the figure in each case, and a horizontal section in each case in the lower part of the figure. FIG. 3*a*) shows a nozzle with two gas apertures per thread in open baffle plate technique, while FIG. 3*b*) shows a design with a threader slit and open yarn intake and outlet. With these known intermingling nozzles, the intermingling of the yarn is incurred by the impact of a gas flow onto the yarn as it runs past, in which situation the angle between the gas apertures 88 and the thread can be between 45° and 90°. The conventional chambers are, if necessary, open, in order for a sharp gas flow to be able to form at all at the outlet of the gas apertures 88, as can be seen in FIG. 3. Accordingly, an essentially ambient pressure pertains in these chambers in the area of the thread.

By a comparison with FIGS. 2 and 3 it becomes particularly clear that the present invention is based on a substantially different intermingling mechanism than the prior art. With the invention, intermingling is effected not by means of a gas flow impinging transversely onto the yarn, but is derived in the gas flow which emerges together with or contrary to the yarn and its direction of run, out of the narrow nozzle apertures 83 and 84 of the chamber 81 according to the invention.

Figure 4:
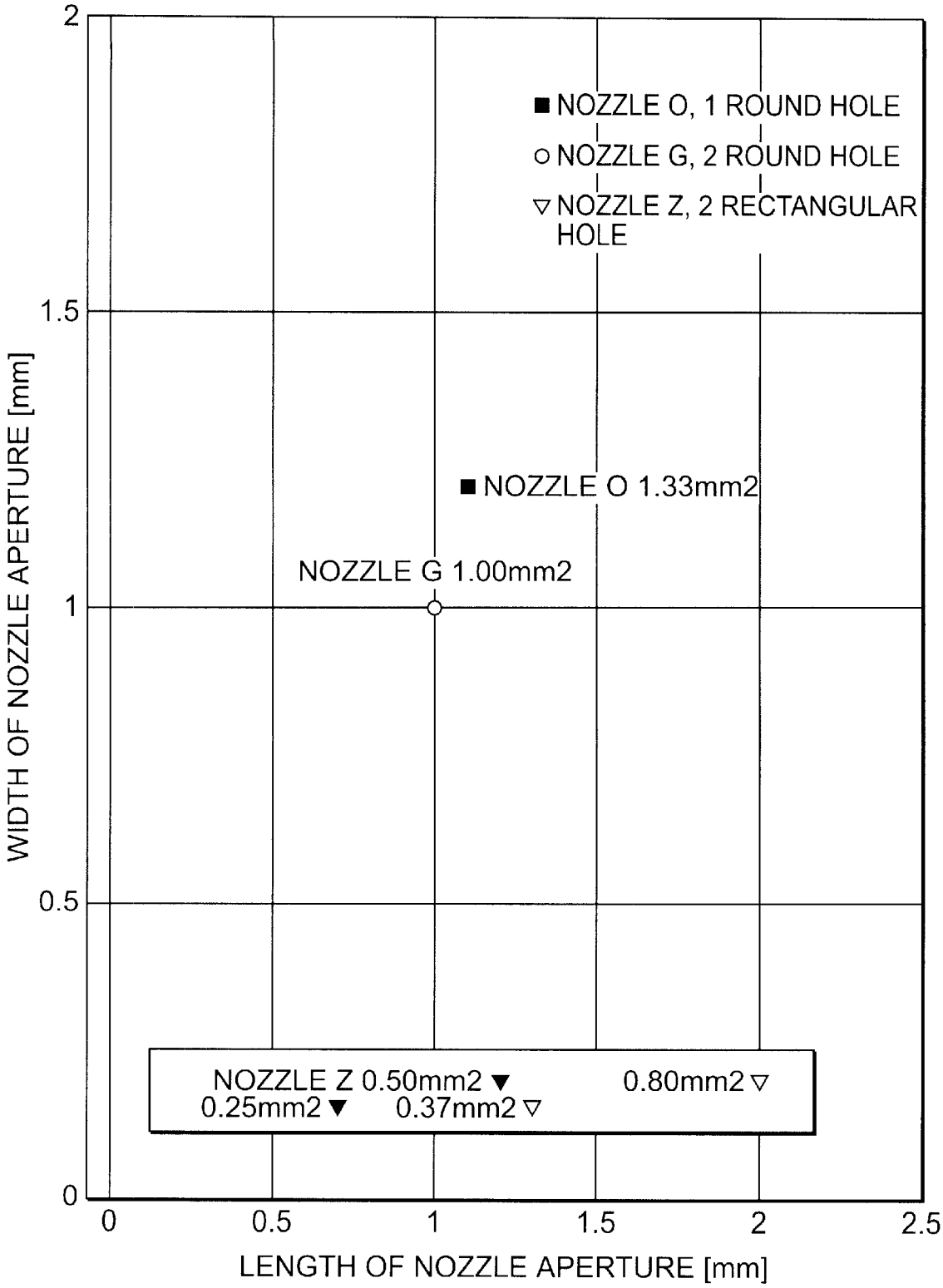
FIG. 4 In diagram form, several cross-sections of nozzle apertures of treatment chambers according to the invention, and also according to the prior art, by way of comparison.
Figure 5A:
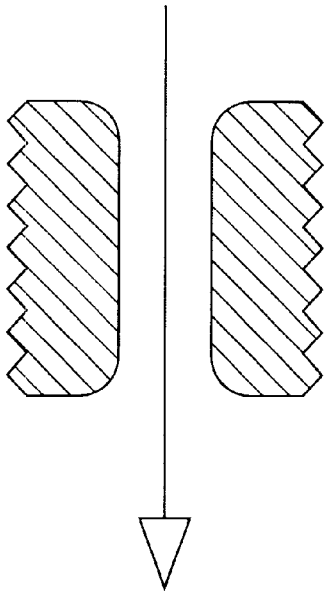
FIGS. 5A–5D Different nozzle geometries for treatment chambers according to the invention, in section.
Figure 5B:
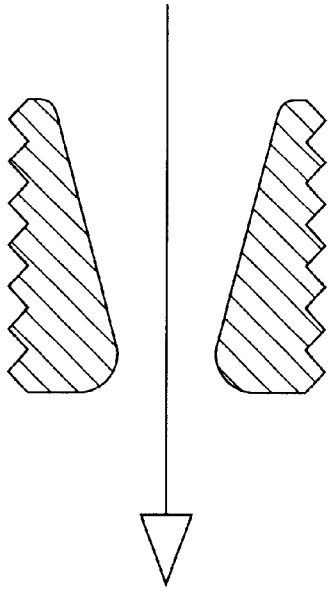
Figure 5C:
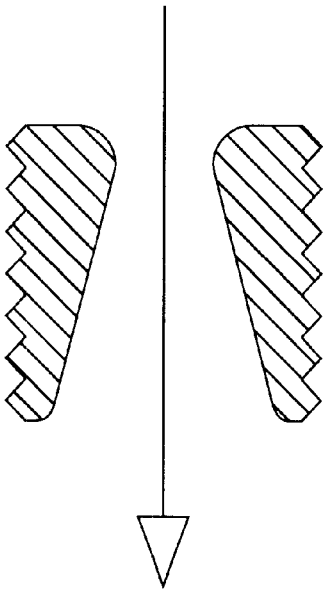
Figure 5D:
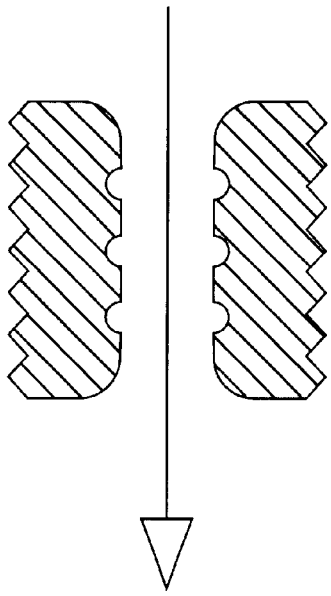

FIG. 4 shows in a representation of length against breadth the size of the surfaces of such nozzle apertures 83/84, which have particularly proved their value in a treatment chamber designed according to the invention, of the type according to FIG. 2. In comparison with this, conventional impingement surfaces of gas apertures 68 of conventional intermingling nozzles according to FIG. 3 are shown, which are perceptibly somewhat larger. The nozzle type designations indicated in FIG. 4 correspond, incidentally, to the previous representations as follows: Z=FIG. 2, G=FIG. 3*a*), and O=FIG. 3*b*). The cross-section of the nozzle apertures 83, 84, available for the emergence of the gas, of the nozzle type Z according to the invention, is even additionally reduced by the cross-section of the yarn. As a consequence, substantially less hot gas is required for the operation of a treatment chamber according to the invention than with conventional technology, as a result of which the economy of the intermingling process is substantially improved.

FIG. 5 shows preferred geometries for the design of the nozzle apertures 83 and 84, whereby a variety of different geometries are possible for the intake nozzle 83 and the outlet nozzle 84, and a number of different effects can be achieved accordingly. For example, by using nozzle forms according to FIG. 5*d*) at the intake and at the outlet, very good sealing of the chamber can be achieved with very low gas consumption. A combination of nozzle shape a) at the intake and c) at the outlet produces a good gas delivery effect and a favourable thread tension at the intake and outlet of the chamber. With a nozzle according to example b) at the intake and example c) at the outlet, a high intermingling effect can be achieved by pre-intermingling at the intake aperture and end intermingling at the outlet aperture. These are just a few examples; other nozzle shapes and combinations are likewise conceivable.

As can also be seen from FIG. 4, the cross-section of the intake and/or outlet aperture is for preference between 0.1 $mm^2$ and 1 $mm^2$. As FIG. 4 further shows, the nozzle apertures are for preference also rectangular, with a side proportion for preference of between 1:5 and 1:10, and with a length of, for preference, between 0.5 mm and 2.5 mm, and a width for preference of between 0.2 and 0.5 mm. In comparison with the nozzle cross-sections, the treatment chamber 81 features a substantially greater cross-section, for preference between 10 $mm^2$ and 30 $mm^2$. The expansion between the intake aperture 83 and the outlet aperture 84 is again substantially greater than the width perpendicular to this, and amounts for preference to between 30 mm and 150 mm. The cross-section of the feed aperture 82 amounts for preference to between 100 $mm^2$ and 200 $mm^2$.

On the basis of Table 1 below, the advantages which can be attained with the invention are set out in greater detail.

TABLE 1

| | | Example | | | | | | | | | | |
|---|---|---|---|---|---|---|---|---|---|---|---|---|
| | | 1 | 2 | 3 | 4 | 5 | 6 | 7 | 8 | 9 | 10 | 11 |
| Polymer | | PET | PET | PA6 | PA6 | PA6 | PA6 | PA6.6 | PA6 | PA6 | PA6 | PA6 |
| Titre | dtex | 84 | 84 | 110 | 110 | 110 | 55 | 44 | 55 | 110 | 110 | 110 |
| Number of holes | | 34 | 34 | 24 | 24 | 24 | 48 | 12 | 48 | 24 | 24 | 24 |
| Spinning speed | m/min | 5315 | 5350 | 4371 | 4375 | 4369 | 4370 | 4238 | 4363 | 4970 | 4372 | 4376 |
| Winding speed | m/min | 6315 | 6343 | 5007 | 5002 | 5004 | 5003 | 5370 | 4998 | 5513 | 5009 | 5003 |
| Relaxation shrinkage | % | 6.89 | 6.32 | 10.00 | 10.03 | 9.49 | 9.53 | 3.52 | 9.56 | 10.25 | 9.45 | 9.95 |
| Draw ratio | 1: | 1.270 | 1.260 | 1.260 | 1.258 | 1.254 | 1.254 | 1.312 | 1.255 | 1.223 | 1.254 | 1.257 |

TABLE 1-continued

| | | | | | | | | | | | | |
|---|---|---|---|---|---|---|---|---|---|---|---|---|
| Drawing aid, steam | bar | — | — | — | — | — | 1.50 | | | | | |
| Relaxation nozzle | Typ | O | O | O | O | O | G | G | O | Z | Z | Z |
| Thread intake/outlet | | | | | | | | | | Sym | Sym | Sym |
| Dwell time | millisec | 0.24 | 0.48 | 0.30 | 0.30 | 0.30 | 0.22 | 0.22 | 0.30 | 0.86 | 0.43 | 0.43 |
| Effective free surface | $mm^2$ | 1.33 | 1.33 | 1.33 | 1.33 | 1.33 | 1.00 | 1.00 | 1.69 | 0.56 | 0.56 | 0.56 |
| Pressure | bar | 5.4 | 5.4 | 4.5 | 3.0 | 1.5 | 4.5 | 3.5 | 3.0 | 6.0 | 1.5 | 4.5 |
| Measured temperature | ° C. | 105 | 104 | 106 | 106 | 103 | 103 | 107 | 105 | 163 | 127 | 153 |
| Elongation | % | 32 | 31.4 | 44.3 | 44.3 | *** | 38.3 | *** | 37.6 | 44.1 | 44.7 | 45.2 |
| Strength | cN/dtex | 4.07 | 4.03 | 4.90 | 4.90 | | 4.97 | | 5.06 | 4.98 | 4.95 | 4.93 |
| T10 | cN/dtex | 242 | 242 | 190 | 190 | | 111 | | 121 | 207 | 211 | 208 |
| Modulus 1% *100 | | | | | | | | | | | | |
| Boil-off shrinkage | % | 8.7 | 8.5 | 11.7 | 11.8 | | 11.8 | | 12.2 | 9.1 | 11.2 | 10.6 |
| Shrinkage force | cN | | | 115 | 118 | | 73 | | 75 | 119 | 124 | 122 |
| Intermingling | n/m | 15 | 14 | 14 | 12 | | 24 | | 13 | 15 | 14 | 16 |
| Thread cohesion* | | 3 | 2 | 3 | 3 | | 1–2 | | 2 | 5 | 5 | 5 |
| Friction (thread/ceramics) | | | | 0.380 | 0.383 | | 0.395 | | 0.399 | 0.377 | 0.367 | 0.357 |
| Thread surface** | | | | b | b | | a | | b | c | c | c |

| | | Examples | | | | | | |
|---|---|---|---|---|---|---|---|---|
| | | 12 | 13 | 14 | 15 | 16 | 17 | 18 |
| Polymer | | PA6 | PET | PA6.6 | PET | PET | PET | PET |
| Titre | dtex | 55 | 84 | 78 | 84 | 84 | 84 | 84 |
| Number of holes | | 48 | 36 | 36 | 36 | 36 | 36 | 36 |
| Spinning speed | m/min | 4375 | 5399 | 4311 | 5413 | 5401 | 5398 | 5400 |
| Winding speed | m/min | 5008 | 6388 | 5301 | 6402 | 6400 | 6399 | 6397 |
| Relaxation shrinkage | % | 9.64 | 6.75 | 9.71 | 6.54 | 6.42 | 6.29 | 6.53 |
| Draw ratio | 1: | 1.255 | 1.263 | 1.349 | 1.260 | 1.261 | 1.260 | 1.262 |
| Drawing aid, steam | bar | — | — | — | — | — | — | — |
| Relaxation nozzle | Typ | Z | Z | Z | Z | Z | Z | Z |
| Thread intake/outlet | | | Sym | Sym | Sym | Sym | Sym | asym |
| Dwell time | millisec | 0.39 | 0.68 | 0.86 | 0.66 | 0.68 | 0.68 | 0.66 |
| Effective free surface | $mm^2$ | 0.68 | 0.65 | 0.70 | 0.23 | 0.65 | 0.65 | 0.65 |
| Pressure | bar | 4.5 | 5.4 | 5.1 | 5.0 | 8.0 | 2.0 | 5.0 |
| Measured temperature | ° C. | 154 | 160 | 157 | 159 | 173 | 133 | 158 |
| Elongation | % | 38.5 | 31.5 | 41.2 | 31.8 | 32.2 | 33.6 | 32.1 |
| Strength | cN/dtex | 5.00 | 4.08 | 4.76 | 4.01 | 3.97 | 4.16 | 4.04 |
| T10 | cN/dtex | 118 | 245 | 159 | 239 | 235 | 243 | 241 |
| Modulus 1% *100 | | | | | | | | |
| Boil-off shrinkage | % | 10.7 | 7.0 | 8.2 | 7.2 | 6.1 | 8.8 | 7.0 |
| Shrinkage force | cN | 79 | | | | | | |
| Intermingling | n/m | 12 | 14 | 14 | 15 | 18 | 14 | 16 |
| Thread cohesion* | | 4 | 5 | 4 | 5 | 5 | 5 | 5 |
| Friction (thread/ceramics) | | 0.392 | | | | | | |
| Thread surface** | | c | c | | | | | |

*Thread compaction evaluation visually in water bath =>0–5
0 = Thread very open, little and irregular intermingling
3 = Relatively regular knots, thread between them open
5 = Complete and continuously closed thread
**Thread surface evaluation by means of REM =>a–c
a = Unevenness on the capillary surface, no damage
b = No miniature unevenness, frequent instances of damage to the thread surface
c = Few microdeposits, hardly any damage
***Yarn cannot be wound up The basic means of operation in Examples 1 to 18 according to Table 1 is as follows: Melt-spinnable polymer granulate of an intrinsic viscosity suitable for spinning into a textile yarn is melted in an extruder in a known manner, conducted by means of a spinning pump to a spinneret, and there extruded through fine apertures. The emerging filaments are cooled, a spinning oil is added, and they are taken up by a godet roller at the spinning speed. The thread is drawn to a FDY (Fully Drawn Yarn) by means of a drawing roller which is running faster by a specific amount. Thereafter, but in the same operating cycle, the yarn is conducted through a treatment chamber into which steam is introduced in each case, and is finally wound up.

Examples 1 to 5 and 8 are methods of operation by known means, making use of a conventional commercial treatment chamber or intermingling nozzle respectively, with the designation O, as is used conventionally for operation with compressed air, but which in these examples was operated with steam. This corresponds approximately to that shown in FIG. 3*b*).

Figure 6:
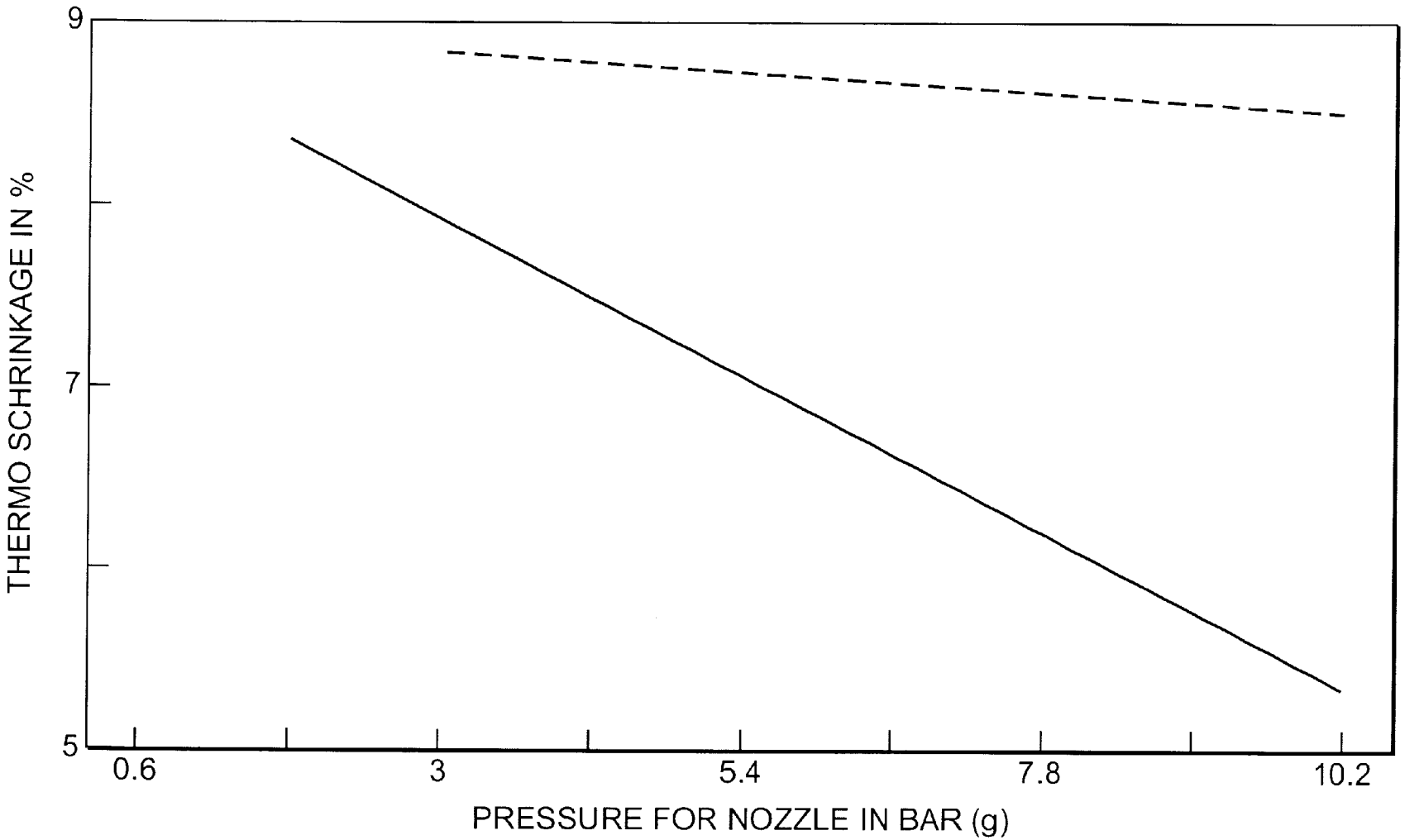
FIG. 6 In diagram form, the pressure dependency of the thermoshrinkage derived with a device according to the invention, as well as, in comparison with this, the corresponding dependency according to the prior art.

Example 6 uses a treatment chamber (nozzle) especially well-suited for operation with a hot gas medium, with the designation G, likewise in a known design similar to that of FIG. 3*a*). In this situation, drawing with cold godets is likewise carried out. A stable bobbin structure is derived. The steam consumption is relatively high, corresponding to the nozzle aperture indicated, and any influence on the thermoshrinkage is only possible to an insignificant degree (see FIG. 6, explained in greater detail hereinafter). The yarn manufactured in this manner is also known by the designation "H4S".

In Example 7, the structure corresponds to that of Example 6, but a steam treatment nozzle is additionally inserted in the drawing field between the cold godet rollers. The treatment length in the steam nozzle is 49 mm, and the pressure 1.5 bar (g). For relaxation, the same intermingling nozzle (G) is operated with steam as in Example 6. This method of operation basically corresponds to that as is described in U.S. Pat. No. 5,750,215 described in the preamble. The yarn manufactured in this manner cannot be wound up to form larger bobbins, since it shrinks further on the winding bobbin, compresses this, and makes it impossible to remove the bobbin from the chuck. The yarn has already undergone heat treatment in the drawing zone, close to the relaxation heating, with the result that no further sufficient relaxation can be effected in the subsequent relaxation treatment, and the thread contracts on the bobbin, as a result of which both the yarn and the bobbin are damaged. Small quantities of yarn can however be collected by using this technique, and checked for uniformity of drawing force (CV in %), which resulted in 2.5%. In comparison, without steam drawing, a value of 1.7% is derived for this value.

Examples 9 to 18 are techniques according to the concept of the invention, making use of a treatment chamber with the designation Z, approximately in accordance with FIG. 2. With the chamber according to the invention, the yarn is treated during the time specified at the gas pressure specified, i.e. overpressure. The yarn treated in this manner is wound up under defined thread tension. The designation "H5S" is given to the yarn manufactured in accordance with the invention.

As can easily be recognised from the figures in Table 1, the technique according to the invention has substantial advantages in comparison with the prior art:

The operational window is substantially widened, since working is already possible at low steam pressures with the technique according to the invention, thanks to adequate thread relaxation, by contrast with the known technique (Examples 5 and 10).

Boui-off shrinkage of the yarn manufactured in accordance with the invention can be adjusted by the possibility of setting the steam pressure and the duration of treatment over a wide range, which is not possible with the technique according to the comparison examples (see Examples 3 and 4, and 15 and 16 respectively). This dependency, i.e. the influence of the steam pressure on the boil-off shrinkage, with the example of PET (titre **84*f* 36 dtex) is shown even more clearly in the diagram of FIG. 6**, in which situation the lower, steeper line represents the dependency with the technique according to the invention, and the upper, flatter dotted line represents the conventional technique.

With the technique according to the invention, the intermingling which results is relatively independent of the value of the gas pressure, but is nevertheless of the order of magnitude which is found in conventional devices at substantially higher gas consumption.

The yarn manufactured according to the invention features consistently lower thread/ceramic friction values in comparison with that manufactured in accordance with the prior art. These values are likewise reproduced in Table 1, and were measured with an F-meter from Rothschild-Messinstrumente, Zurich, Switzerland. The reason for these favourable friction values is probably that the yarn manufactured in accordance with the invention features fewer instances of damage on the thread surface, which could clearly be identified when the cross-section of the thread was examined at a magnification of about 2000 times under an SEM (Scanning Electron Microscope), and which may be attributable to the intermingling gas jet being directed in the same direction as the thread run.

A method of testing yarn known throughout the world is, in particular, the examination of the thread cohesion in a water bath. In this situation, the number of intermingling points is counted on a piece of thread laid on the water surface, at a defined thread length. The method has advantages over the various automated methods, because it provides an impression of the nature of the intermingling points. In the context of this test method, it was found, surprisingly, that the yarn manufactured according to the invention features a consistently closed thread composition, which shows no opening, or practically none, over the entire thread length. By contrast with this, conventionally manufactured yarns show constrictions at intervals of 6 to 8 cm, and between them the thread opens in balloon fashion into the individual capillaries of the thread. A good thread cohesion, such as pertains with the technique according to the invention, is of great advantage for go further processing.

The yarn from Examples 3, 6, 8, 11, 12 was also introduced by means of a projectile loom as the weft in a chain made of PET transparent trilobal 22 dtex f 1 voile. The following assessment of the weaving properties of the yarn were derived:

TABLE 2

| Example | Titre (dtex) | Winding speed (m/min) | Steam treatment nozzle | Air pressure (bar) | Thread breaks per 600 m | Thread cohesion (visually assessed) |
|---|---|---|---|---|---|---|
| Comp. 3 | 110 f 24 | 5007 | O | 3.8 | 10 | Too open |
| Comp. 6 | 55 f 48 | 5003 | G | 3.5 | 3 | Satisfactory |
| 12 | 55 f 48 | 5008 | Z | 2.9 | 1 | Good thread appearance |
| Comp. 8 | 55 f 48 | 4998 | O | 2.8 | 2 | Satisfactory |
| 11 | 110 f 24 | 5003 | Z | 2.4 | 0 | very good |

to weave the yarn manufactured according to the invention up to 45% less compressed air is required for the thread insertion into the loom. Both types of yarn, manufactured according to the invention, show perceptibly fewer faults during weaving, identifiable from the lower thread break numbers.

The processing medium used in the examples described is steam. The technique is not however restricted to steam;

compressed air is also suitable, with which the influence on the thermoshrinkage is somewhat less due to the poorer heat transfer value.

The device according to the invention can also be used as an intermingling device, with the advantage of savings on energy in comparison with the prior art, thanks to lower compressed air consumption.

Figure 7:
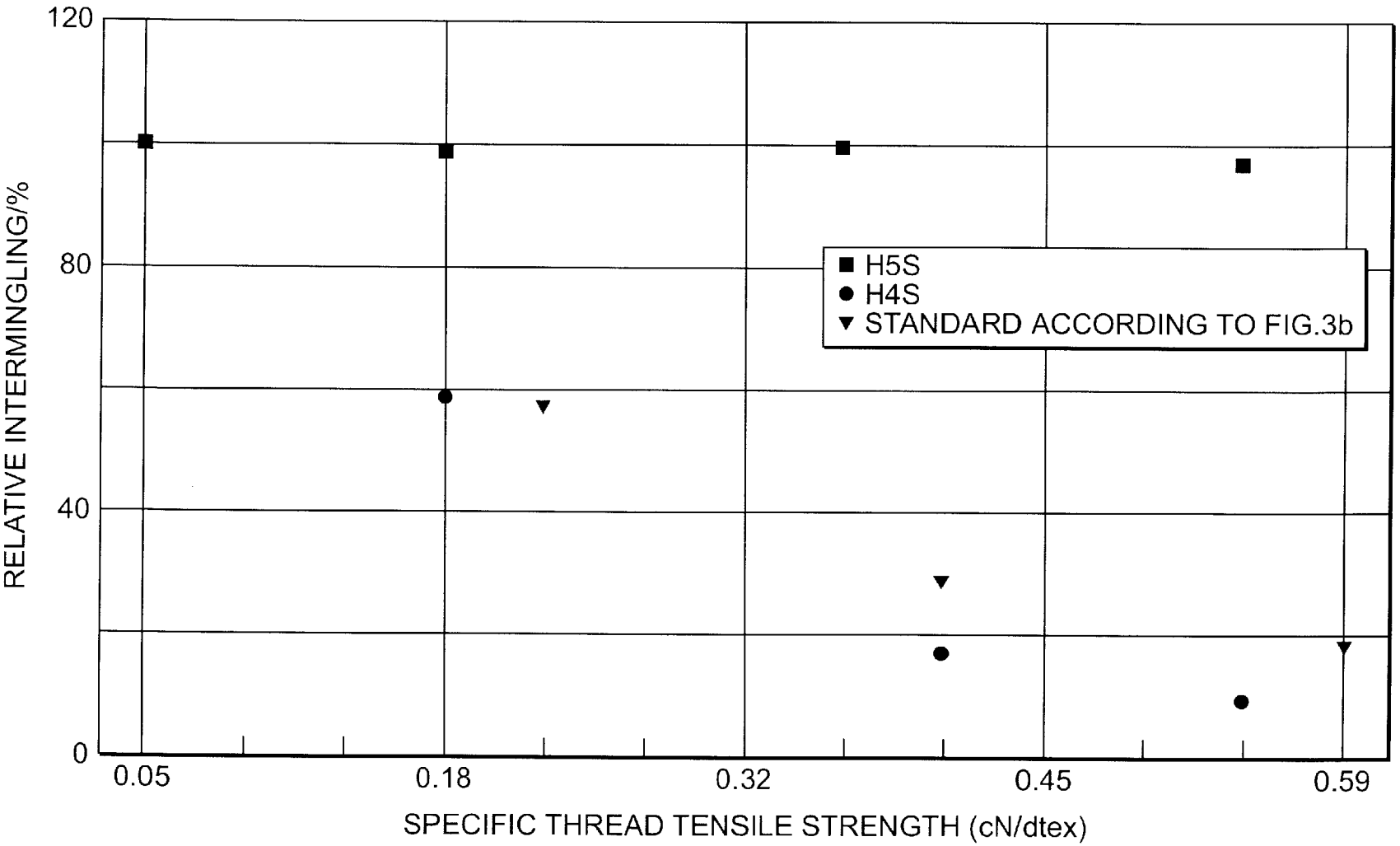
FIG. 7 In diagram form, the relative intermingling as a function of the specific thread drawing force for a yarn manufactured with the device according to the invention, as well as two yarns according to the prior art.

FIG. 7 also shows, in a diagram, the stability of the intermingling process and of the cohesion of the thread respectively (referred to as the entanglement stability or also as knot strength) for an "H5S" yarn manufactured according to the invention. In comparison, the same dependency is also represented for two other "Standard" and "H4S" yarns manufactured according to the prior art, with the "H4S" yarn being manufactured with the use of a treatment chamber operated by steam in accordance with FIG. 3*a*), and the "Standard" yarn was manufactured using a treatment chamber according to FIG. 3*b*), operated by compressed air. All three yarns had the titre 110 dtex f 24, and in the initial state (0.05 cN/dtex) about the same intermingling number of approximately 20 knots per metre was specified.

FIG. 7 shows the "relative intermingling" as a percentage of the intermingling at only low specific thread tensile strength, against this specific thread tensile strength in cN/dtex (CentiNewton/decitex). The measured values entered in FIG. 7 were determined with an intermingling measuring device designated as "Itemat Lab TSI", from Akzo Nobel Faser AG (Enka technica Division), Heinsberg, Germany. With this device, the number of intermingling knots per length unit is initially determined on the running thread with only low thread tension, and is then determined directly with an increased thread tension.

The "H5S" yarn according to the invention unexpectedly shows a practically constant high number of knots up to a specific thread tensile force of 0.5 cN/dtex. The number of knots is reduced in the range shown by only about 10%. By contrast, with both comparison yarns, the number of knots in the same tensile force range declines by about 80% or more. Yarns according to the invention accordingly show a reduction which is certainly not more than 50%, and, in particular, even not more than 30%, in the number of knots per length unit up to a specific thread tensile force of 0.5 cN/dtex.

What is claimed is:

1. A device for the intermingling, relaxing, and/or thermosetting of filament yarn (50) in a melt spinning process, comprising:

a treatment chamber (80, 81), characterized in that the treatment chamber (80, 81), can be filled with a gas under an essentially static overpressure and increased temperature, and includes a feed aperture, an intake aperture (83) and an outlet aperture (84)for the passage of the yam (50), wherein the yarn is permeable under pressure relaxation by the gas, and the feed aperture includes a cross-sectional opening area for feeding the gas into the chamber, and the intake aperture and/or the outlet aperture includes a cross sectional opening area, wherein the feed aperture cross sectional opening area is substantially greater than the outlet aperture cross sectional opening area.

2. A device according to claim 1, characterized in that the intake aperture (83) and/or the outlet aperture (84) of the treatment chamber (80, 81), are nozzles closely surrounding the yarn, with a cross-section between 0.1 $mm^2$ and 1 $mm^2$, and that the treatment chamber (80, 81) by contrast features a substantially greater cross-section between 10 $mm^2$ and 30 $mm^2$.

3. A device according to claim 1 or 2, characterized in that the intake aperture (83) and/or the outlet aperture (84) includes a rectangular cross-section with a ratio between the length of the sides of the rectangular cross-section between 1:5 and 1:10, with a length of between 0.5 mm and 2.5 mm, and a width of between 0.2 and 0.5 mm.

4. A device according to claim 1, wherein the treatment chamber has a length and a width, and characterized in that the length of the treatment chamber (80, 81) between its intake aperture (83) and its outlet aperture (84) is substantially greater than the width of the treatment chamber, wherein the width of the treatment chamber is perpendicular to the length of the treatment chamber, and is between 30 mm and 150 mm.

5. A device according to claim 1, characterized in that the treatment chamber (80, 81) includes a feed aperture (82) for the gas under overpressure and increased temperature, wherein the intake aperture and/or the outlet aperture include a cross-section, and that the cross-sectional opening area of the feed aperture (82) is, substantially greater than the cross-section of the intake aperture (83) and/or the outlet aperture (84), and is between 100 $mm^2$ and 200 $mm^2$.

6. A device according to claim 5, characterised in that the treatment chamber (80, 81), apart from its intake aperture (83), its outlet aperture (84), and the feed aperture (82), is completely enclosed.

7. A device according to claim 1, characterised in that the treatment chamber is made of metal or of an abrasion-resistant coated metal.

8. A device according to claim 1, characterized in that the treatment chamber is made of ceramic material.

9. A device according to claim 1, characterised in that the device is arranged in a system (10-90) for the manufacture of filament yarn by melt spinning of polymer masses between a spinning drawing length and/or drawing length (60, 70), and a winding-up device (90) for the yam (50).

10. A device according to claim 9, characterized in that the device is arranged in the system directly in front of the winding-up device (90).

11. A device according to claim 1, characterised in that the device is operated with steam as the gas under an absolute pressure of between 1.5 and 10 bar.

12. A device for the intermingling, relaxing, and/or thermosetting of filament yarn (50) in a melt spinning process, the device comprising a treatment chamber (80), adapted to be filled with a gas under an essentially static overpressure and increased temperature, the treatment chamber including a feed aperture, an intake aperture (83) and an outlet aperture (84)for the passage of the yam: (50), wherein the yam is permeable under pressure relaxation by the gas, and wherein the device is located to pass the yarn (50) directly from the outlet aperture (84) to a yam winding-up device (90), and the feed aperture includes a cross-sectional opening area for feeding the gas into the chamber, and the intake aperture and/or the outlet aperture includes a cross sectional opening area, wherein the feed aperture cross sectional opening area is substantially greater than the outlet aperture cross sectional opening area.

13. A device for intermingling, relaxing, and/or thermosetting of filament yarn (50) in a melt spinning process, comprising a treatment chamber (80, 81) filled with a gas under overpressure and increased temperature including:

a feed aperture for feeding the gas into the treatment chamber, an intake aperture (83) permeable for the gas and for the passage of the yarn (50), an outlet aperture (84) permeable for the gas and for the passage of the yam (50), wherein the feed aperture, the intake aperture and the outlet aperture each include a cross sectional opening area, the feed aperture cross sectional opening area being substantially greater than the cross sectional areas of both the intake aperture and the outlet aperture, and wherein the overpressure of the gas fed through the feed aperture into the treatment chamber being essentially static and essentially does not start to relax until the gas flows out of the treatment chamber through the intake and/or outlet aperture.

14. A device according to claim 13, characterized in that the cross-sectional it opening area of the feed aperture is between 100 $mm^2$ and 200 $mm^2$.

15. A device according to claim 13, characterized in that the device is arranged in a system (10-90) for the manufacture of filament yarn by melt spinning of polymer masses between a spinning drawing length and a drawing length (60, 70) and a winding-up device (90) for the yarn, wherein the yarn is advanced at the spinning drawing length and drawing length (60, 70) with a first velocity, wherein the yarn is wound-up by the winding-up device (90) with a second velocity, and wherein the second velocity is lower than the first velocity.

16. A device according to claim 15, characterized in that no means are provided for the heating of the yam the spinning drawing length and/or the drawing length (60, 70).

17. A device for intermingling, relaxing, and thermosetting of filament yarn (50) in a melt spinning process, comprising a treatment chamber (80, 81) filled with a gas under overpressure and increased temperature including:

a feed aperture (83) permeable for the gas into the treatment chamber, and an intake aperture (83) permeable for the gas and for the passage of the yarn (50), an outlet aperture (84) permeable for the gas and for the passage of the yarn (50), wherein the feed aperture, the intake aperture and the outlet aperture each include a cross sectional area, the feed aperture cross sectional opening area being substantially greater than the cross sectional areas of both the intake aperture and the outlet aperture, wherein the overpressure of the gas fed through the fed aperture into the treatment chamber being essentially static and the overpressure of the gas essentially does not start to relax until the gas flows out of the chamber through the intake and/or outlet apertures, and wherein the device is located to pass the yarn (50) directly from the outlet aperture (84) to a yarn winding-up device (90).

* * * * *